United States Patent [19]

Meier

[11] Patent Number: 4,925,120

[45] Date of Patent: May 15, 1990

[54] METHOD OF, AND APPARATUS FOR, PROCESSING PRINTED PRODUCTS ARRIVING IN AN IMBRICATED FORMATION, ESPECIALLY NEWSPAPERS, PERIODICALS AND THE LIKE

[75] Inventor: Jacques Meier, Bäretswill, Switzerland

[73] Assignee: Ferag AG, Hinwil, Switzerland

[21] Appl. No.: 281,784

[22] Filed: Dec. 9, 1988

Related U.S. Application Data

[63] Continuation of Ser. No. 42,343, Apr. 24, 1987.

[30] Foreign Application Priority Data

Apr. 28, 1986 [CH] Switzerland ..... 1730/86

[51] Int. Cl.[5] ..... B65H 29/12; B65G 7/00

[52] U.S. Cl. ..... 242/59; 242/58.6; 242/79; 414/784; 414/789.2

[58] Field of Search ..... 242/58.6, 59, 79; 414/38, 39, 29, 784

[56] References Cited

U.S. PATENT DOCUMENTS

| | | | |
|---|---|---|---|
| 3,675,788 | 7/1972 | Cathers | 414/784 |
| 3,883,007 | 5/1975 | Hirshboeck | 414/784 X |
| 4,438,618 | 3/1984 | Honegger | 414/29 X |
| 4,610,592 | 9/1986 | Pienta | 414/38 |
| 4,640,657 | 2/1987 | Moore et al. | 414/39 X |

FOREIGN PATENT DOCUMENTS

| | | |
|---|---|---|
| 2234936 | 1/1974 | Fed. Rep. of Germany . |
| 435116 | 10/1967 | Switzerland . |

*Primary Examiner*—Stuart S. Levy
*Assistant Examiner*—Steven M. Dubois
*Attorney, Agent, or Firm*—Fleit, Jacobson, COhn, Price, Holman & Stern

[57] ABSTRACT

A pallet loaded with a plurality of adjacently arranged wound product packages is tilted through an angle of approximately 90° about a horizontal axis by means of a tilt or pivot device. Consequently, the wound product packages which are of substantially the same size and arranged such that the lengthwise axes thereof, which extend in horizontal direction and are in aligment with one another, are brought into a position in which the wound product packages bear upon one another and form a package tower or stack. As a result, the lengthwise axes of these wound product packages, now in tower or stack configuration, extend in substantially vertical direction. The wound product packages which bear upon one another, during the course of the tilting motion, are again placed upon a pallet which, prior to the tilting operation, is arranged laterally adjacent the wound product packages which are located adjacent one another.

26 Claims, 4 Drawing Sheets

METHOD OF, AND APPARATUS FOR, PROCESSING PRINTED PRODUCTS ARRIVING IN AN IMBRICATED FORMATION, ESPECIALLY NEWSPAPERS, PERIODICALS AND THE LIKE

CROSS-REFERENCE TO RELATED APPLICATION

This application is a continuation of the commonly assigned, co-pending U.S. Application Ser. No. 07/042,343, filed Apr. 24, 1987 which is, in turn, related to the commonly assigned, copending U.S. Application Ser. No. 07/042,329, filed Apr. 24, 1987, entitled "METHOD OF, AND APPARATUS FOR, PROCESSING PRINTED PRODUCTS, ESPECIALLY NEWSPAPERS, PERIODICALS AND THE LIKE".

BACKGROUND OF THE INVENTION

The present invention relates to a new and improved method of, and apparatus for, processing printed products, especially although not exclusively, newspapers, periodicals and the like.

In its more particular aspects, the present invention specifically relates to a new and improved method for processing of printed products arriving in an imbricated formation, such as newspapers, periodicals and the like, wherein the imbricated formation together with a tensioned winding band or strap is wound onto a hollow substantially cylindrical winding core or mandrel which rotates about an essentially horizontal axis. During the winding-up of the printed products which are infed in an imbricated formation a flat side or face of each such printed product confronts the hollow substantially cylindrical winding core or mandrel.

The present invention also relates to a method for processing printed products, such as newspapers, periodicals and the like, which have been wound upon a hollow substantially cylindrical winding core or mandrel in imbricated formation and in conjunction with a winding band or strap, wherein the printed products together with the winding band or strap are unwound from the wound product package previously formed on the winding core or mandrel.

As already heretofore noted the present invention also aims at the provision of a new and improved apparatus for processing printed products arriving in an imbricated formation and useful for the practice of the method aspects of the present development.

It is already known in this technology to wind as many printed products as possible onto a winding core or mandrel in order to avoid too frequent exchange of a full or finished wound product package against an empty winding core or, conversely, an empty winding core for a new wound product package in consideration of the presently prevailing conventional high operating speeds of modern rotary printing presses and their subsequently arranged processing equipment. Significant in this regard are Swiss Patent No. 559,691, granted Jan. 31, 1975 and Swiss Patent No. 642,602 and its cognate U.S. Pat. No. 4,438,618, granted Mar. 27, 1984. Wound product packages of such type are very large in size and heavy and cannot be easily handled or manipulated.

In the aforementioned Swiss Patent No. 559,691 it has been proposed to provide the hollow cylindrical winding core with disk-shaped lateral plates or cheek plates, the diameter of which is larger than the diameter of the wound product package which is formed from the wound-up printed products. These lateral plates or cheek plates are constructed to function as rolling rims or rings which render possible a rolling of the winding core together with the printed products wound thereupon. The wound winding cores are individually delivered from the wind-up station to an intermediate storage, and the winding core is rolled over at least a portion of its path of travel along inclined surfaces or planes. However, there are also used circular conveyors or chain conveyors for the transport of the wound product packages.

It is also furthermore known in this technology to transport the large size or voluminous and heavy wound product packages by means of specially constructed transport devices suitable for this purpose between the wind-up stations and the unwinding or wind-off stations and an intermediate storage or storage unit. Significant in this regard is the published PCT application Ser. No. WO 85/01279 and the corresponding U.S. Pat. No. 4,641,795, granted Feb. 10, 1987.

SUMMARY OF THE INVENTION

Therefore, with the foregoing in mind it is a primary object of the present invention to provide a new and improved method of, and apparatus for, processing printed products arriving in an imbricated formation, especially although not exclusively, newspapers, periodicals and the like, in a manner which is not afflicted with the drawbacks and limitations of heretofore known constructions.

Another and more specific object of the present invention aims at the provision of a new and improved method of, and apparatus for, processing printed products, such as newspapers, periodicals and the like, arriving in an imbricated formation, wherein it is possible to process the printed products in a simplified manner and, in particular, to handle or manipulate the processed printed products in a much simpler fashion than was heretofore possible.

Yet a further significant object of the present invention is directed to a new and improved construction of an apparatus for processing printed products, such as newspapers, periodicals and the like, arriving in an imbricated formation and wound into product packages, wherein handling of the wound product packages can be carried out in an extremely reliable and efficient fashion, promoting both the winding-up of the imbricated product formation into wound product packages and the unwinding of the wound product packages to reestablish the imbricated product formation.

Yet a further noteworthy object of the present invention aims at the provision of a new and improved construction of apparatus for processing products, especially printed products, which processing apparatus is of relatively simple construction and design, quite economical to manufacture, highly reliable in its operation, not readily subject to breakdown or malfunction, and requires a minimum of maintenance and servicing.

Now in order to implement these and still further objects of the invention, which will become more readily apparent as the description proceeds, the method of processing printed products arriving in an imbricated formation and which have been wound-up into a wound product package upon a winding core or mandrel, contemplates that a number of the finished or fully wound product packages are placed adjacent or alongside one another such that the lengthwise or longitudinal axis of each wound product package extends essentially in horizontal direction, the adjacently arranged wound product packages are conjointly tilted or pivoted through an angle of approximately 90° about an essentially horizontally extending axis and brought into a position in which the wound product packages, with the lengthwise axis of each such wound product package extending in an essentially upright or vertical direction, bear upon one another.

According to a further method aspect of the present invention the wound product packages, each of which have been wound onto a related winding core or mandrel together with the associated tensioned winding band, is manifested by the features that the wound product packages, which bear upon or are stacked upon one another, prior to undergoing the unwinding operation, and with the lengthwise axis of each such wound product package extending essentially in an upright or vertical direction, are conjointly tilted or pivoted through an angle of approximately 90° about an axis extending essentially in horizontal direction and brought into a position in which the wound product packages are arranged adjacent one another or in side by side relationship with the lengthwise axis of each such wound product package now extending essentially in horizontal direction.

As alluded to above, the present invention is not only concerned with the aforementioned method aspects, but also relates to an improved apparatus for the performance thereof. Such apparatus comprises a tilting or pivoting device or mechanism for the conjoint tilting of a plurality of wound product packages. Such tilting mechanism possesses two supports or support members disposed approximately at right angles to one another and which can be conjointly pivoted through an angle of approximately 90° about an essentially horizontally extending axis.

By virtue of the inventive measures, instead of individually transporting the formed wound product packages with the lengthwise axis of each such wound product package extending in horizontal direction, a plurality of such wound product packages are positioned adjacent or in side by side relationship to one another and then conjointly tilted or pivoted in such a manner that they bear upon one another in a substantially tower-like or stack configuration. In this tower-like or stack configuration it is possible to readily transport the wound product packages. To this end, the wound product packages are preferably placed upon a support element or support member constructed as a transport element, rendering possible a mechanized or automated loading of a plurality of wound product packages. If there is used as the support element or support member a pallet, especially a standardized pallet, then the transport of the wound product packages can be accomplished by conventional equipment or expedients, for instance forklift trucks.

The storage of such tower-like array or stacked configuration of wound product packages can likewise be accomplished in a simple and space-saving fashion.

At the unwinding station the wound product packages which bear upon one another are again conjointly tilted or pivoted through an angle of approximately 90° and thus brought into a position in which they are again arranged as was originally the case adjacent one another or in side by side relationship. Consequently, the lengthwise axes of the wound product packages again extend approximately in horizontal direction as such is required for the package unwinding operation.

It is here further noted that in German Patent No. 941,600, published Feb. 12, 1953, and originally patented in West Germany on Mar. 11, 1941, there is disclosed a tilting device for rolls formed of wire or band iron, by means of which a number of adjacently positioned rolls can be tilted through an angle of 90°. In this way there is formed a stack having a vertical lengthwise axis in that the rolls now lie or bear upon one another. This stack is collectively displaced as a unit from the tilting device onto a transport device which outfeeds the stack.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing thereof only enough of the structure of the product processing apparatus has been conveniently illustrated therein as is needed to enable one skilled in the art to readily understand the underlying principles and concepts of the present development.

Figure 1:
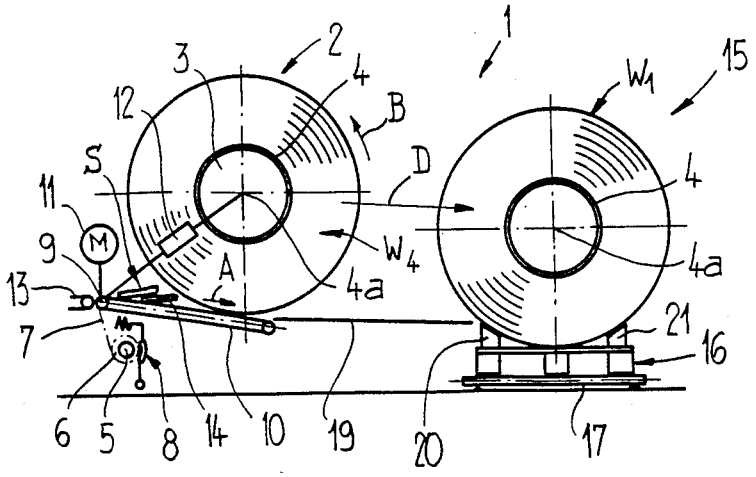
FIG. 1 is a side view of a wind-up station.
Figure 2:
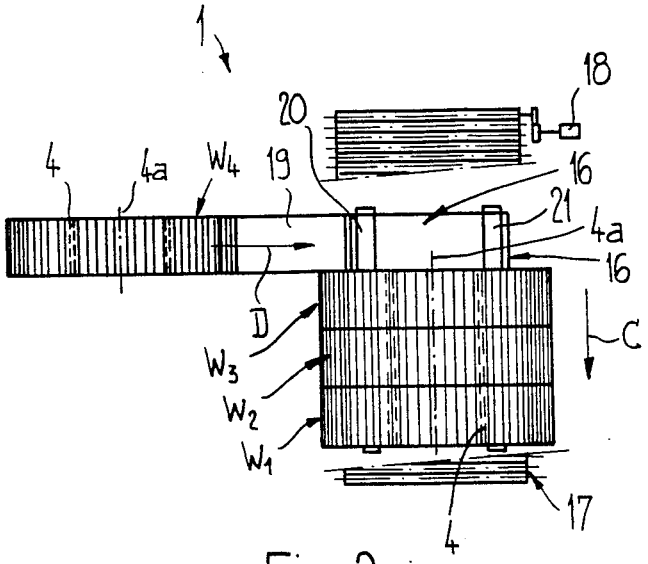
FIG. 2 is a top plan view of the wind-up station depicted in FIG. 1.

Turning attention now specifically to FIGS. 1 and 2 of the drawings, the apparatus illustrated therein by way of example and not limitation will be seen to comprise a wind-up station 1 which contains a mounting or support arrangement or device 3 which defines a wind-up position or location 2. This mounting or support arrangement or device 3 serves for the mounting or support of hollow substantially cylindrical winding cores or mandrels 4 in such a manner that these winding cores or mandrels 4 can be rotatably driven, as is well known in this technology, about their associated lengthwise axis 4*a* extending essentially in horizontal direction.

Additionally, there is also provided a mounting or support arrangement or device 5 for a supply spool or reel 6 for a winding band or strap 7. Acting upon this supply spool or reel 6 is a brake arrangement or brake device 8. The winding band or strap 7 is guided over a drive roll or roller 9 and extends along the upper side of a band or belt conveyor 10, constructed as a rocker or balance or balance arm, to the winding core or mandrel 4 with which there is operatively connected this winding band or strap 7. The band conveyor 10, the conveying direction of which has been conveniently designated by reference character A in FIG. 1, is pivotably mounted about an axis aligned with the rotational axis of the drive roll or roller 9. This drive roll or roller 9 and also the band conveyor 10 are appropriately driven by a suitable drive motor 11 which, by means of a winding transmission or gearing unit 12, drives the winding core or mandrel 4 in the direction of the arrow B. Arranged forwardly of the band or belt convenyor 10 is an infeed device or infeed conveyor 13 or equivalent structure which delivers in an imbricated formation S the printed products 14 or the like which are to be wound up.

The wind-up station 1 furthermore comprises a magazine or storage unit 15 arranged in neighboring or adjacent relationship with respect to the wind-up position or location 2. Constituting part of this magazine or storage unit 15 is a support element or pallet 16 which bears upon a roller track 17. Reference character 18 designates a suitable driver for operating this roller track 17 or equivalent structure. This roller track 17 has a conveying direction C which extends approximately at right angles to the rolling direction D of the finished or fully wound product package W towards the magazine or storage unit 15. The wind-up position or location 2 is operatively connected by a slightly downwardly inclined roll or rolling track 19 with the support element or pallet 16.

The imbricated formation S of printed products 14 which are delivered by the infeed device 13 are wound, with the flat side of the printed products 14 confronting the winding core of mandrel 4, onto this winding core or mandrel 4 in conjunction with the winding band or strap 7 which is under a tensional stress or tension. As previously mentioned, the winding core or mandrel 4, during the product wind-up or winding operation, is driven so as to rotate in the direction of the arrow B of FIG. 1. The winding-up of the imbricated formation S together with the tensioned winding band or strap 7 upon the winding core or mandrel 4 is accomplished basically in the manner described in detail in the aforementioned Swiss Patent No. 642,602 and the cognate U.S. Pat. No. 4,438,618, to which reference may be readily had and the disclosure of which is incorporated herein by reference.

After completion of a wound product package W the latter is rolled out of the wind-up position or location 2 in the direction of the arrow D into the magazine or storage unit 15. In so doing, this wound product package W bears with the printed products 14 of the outermost winding layer or coil, in other words at its outer surface or circumference, upon the roll or rolling track 19 or equivalent structure. The finished or fully wound product package W arrives at the support element or pallet 16 or equivalent support structure at which it comes to bear at its package circumference. By means of suitable arresting devices, such as the arresting ledges 20 and 21 or equivalent structure the wound product package W is prevented from rolling off of the associated support element or pallet 16.

As soon as the wind-up position or location 2 is free then it is possible to amount thereat a new or empty winding core 4 and to connect such with a new winding band 7. As a result, the wind-up station 1 is now ready for the formation of a new wound product package W.

After a finished or fully wound product package W has been rolled onto the support element or pallet 16 the latter is advanced in the direction of the arrow C. The next wound product package, that is to say in this case the wound product package $W_4$, now comes to lie adjacent the previously erected wound product package, in this case the wound product package $W_3$. The four equal sized wound product packages $W_1$, $W_2$, $W_3$ and $W_4$ are now arranged adjacent one another or in side by side relationship such that the flat sides of these wound product packages confront one another, so that the mutually aligned winding core axes 4*a* essentially extend in horizontal direction.

Figure 3:
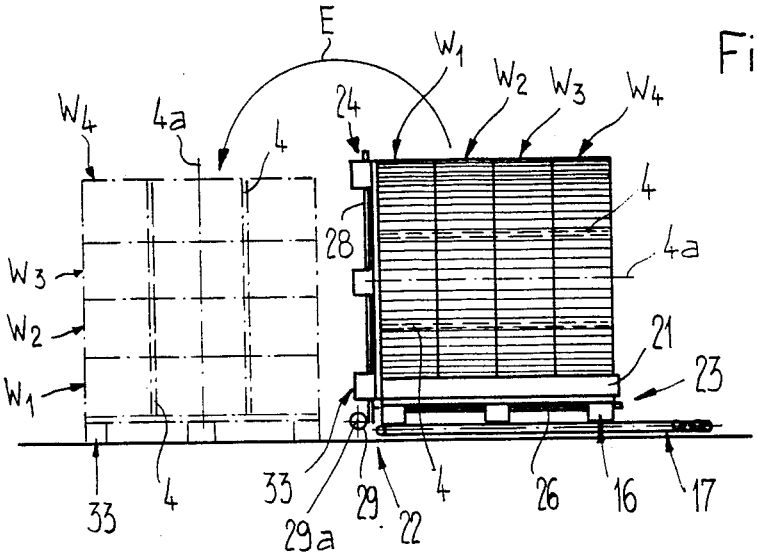
FIG. 3 illustrates in side view a tilting device or mechanism for the simultaneous tilting or pivoting of a plurality of wound product packages removed from the wind-up station depicted in FIGS. 1 and 2.
Figure 4:
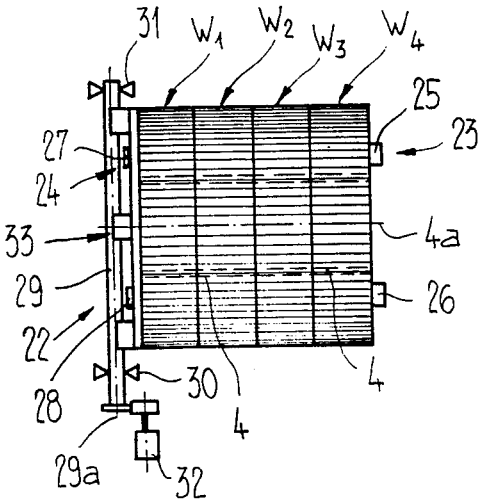
FIG. 4 is a top plan view of the tilting device or mechanism depicted in FIG. 3.

The fully loaded support elements or pallets 16, which constitute movable transport elements, are then conveyed or brought by means of the roller or roll track 17 to a tilting mechanism or device 22 which has been illustrated in detail in FIGS. 3 and 4. This tilting mechanism or device 22 possesses two, namely first and second supports or support members 23 and 24 which are disposed approximately at right angles with respect to one another. Each of these first and second supports or support members 23 and 24 comprises two mutually parallel support arms or arm members 25 and 26 and 27 and 28, respectively, which are arranged in spaced relationship from one another. These support arms or arm members 25, 26, 27 and 28 are mounted at a common pivot or tilt shaft 29 which defines a pivot or tilt axis 29*a*. The pivot shaft 29 is mounted in suitable bearings 30 and 31 and operatively connected with a suitable drive or drive means 32 which serves to appropriately pivot or rotate the pivot shaft 29.

The loaded support element or pallet 16 which is delivered by means of the roller track 17 is brought into a position in which the support element or pallet 16 is located over the first support arms 25 and 26 of the support or support member 23. Previously there is placed or arranged at the support arms 27 and 28 of the second support member 24 and which supports arms extend approximately in vertical direction, an empty support element or pallet 33 which constitutes a movable transport element. At this pallet 33 there comes to bear one of the wound product packages located upon the support element or pallet 16, that is to say, the wound product package $W_1$ with its freely exposed side surface or face.

Now by means of the drive or drive means 32 the tilting mechanism or device 22 is tilted through an angle of approximately 90° about the pivot or tilt axis 29*a* extending essentially in horizontal direction in the direction of the arrow E as shown in FIG. 3. As a result, the previously adjacently arranged wound product packages $W_1$, $W_2$, $W_3$ and $W_4$ are brought into a position in which they bear upon one another in a tower-like or stacked configuration with the lengthwise axis 4*a* of each wound product package now extending essentially in vertical direction, as such has been depicted in chain-dot lines in FIG. 3. As a result, the wound product packages $W_1$, $W_2$, $W_3$ and $W_4$ bear upon and are supported by the support element or pallet 33. The originally loaded, now empty support element or pallet 16 with the arresting ledges or ledge members 20 and 21 can now be removed and delivered for further use.

The wound product packages $W_1$, $W_2$, $W_3$ and $W_4$ which are reposing in a tower-like or stacked configuration upon the pallet or pallet member 33 can now be transported away in a simple fashion and through the use of conventional loading means or expedients, such as for example manual lift trucks or forklift trucks and, for instance, stored in an intermediate storage or storage unit. In this intermediate storage it is possible to stack two or more loaded support elements or pallets or pallet members 33 upon one another, affording a space-saving storage of the pellets and the wound product packages supported thereby. The tower-like or stacked structure, composed of the stack of relatively heavy mutually contacting wound product packages $W_1$, $W_2$, $W_3$ and $W_4$, is extremely stable and during handling will not readily fall apart or topple over.

Figure 5:
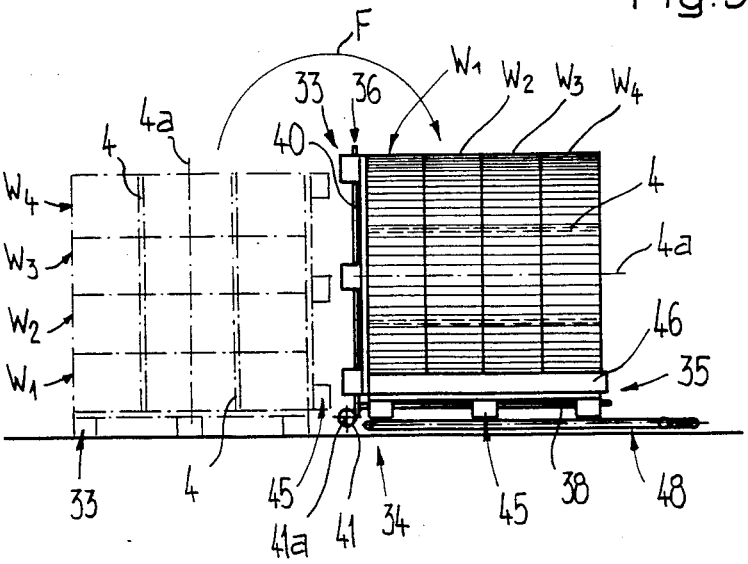
FIG. 5 is a side view of a tilting device or mechanism for the simultaneous tilting or pivoting of a number of wound product packages which are to be brought to an unwinding station.
Figure 6:
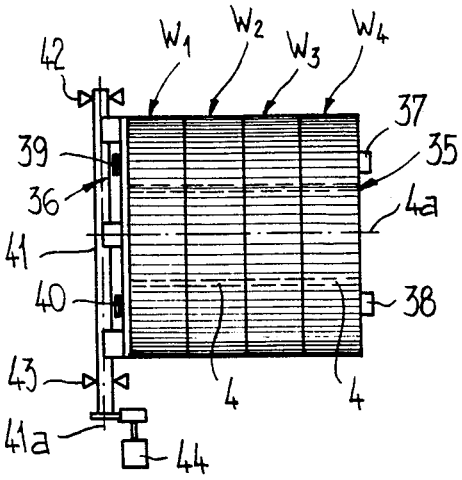
FIG. 6 is a top plan view of the tilting device or mechanism depicted in FIG. 5.

For the further processing of the wound-up printed products 14 the loaded support elements or pallets 33 are transported or brought from the intermediate storage (or, if desired, also directly from a wind-up station 1) to a further tilting mechanism or device 34 which has been illustrated in greater detail in FIGS. 5 and 6 and both in its construction and function corresponds to the tilting mechanism or device 22 discussed previously in conjunction with FIGS. 3 and 4. This further tilting mechanism 34 likewise possesses two namely second and first supports or support members 35 and 36 which are disposed approximately at right angles with respect to one another. Each support or support member 35 and 36 is formed by two mutually parallel support arms or arm members 37 and 38 and 39 and 40, respectively, which extend in spaced relationship from one another. The support arms 37, 38 39 and 40 are secured to a common pivot or tilt shaft 41 which defines a horizontal pivot axis 41*a*. The pivot shaft 41 is mounted in suitable bearings 42 and 43 and operatively connected with a suitable drive and drive means 44 which serves to rotate the pivot shaft 41 together with the support arms 37, 38, 39 and 40.

The loaded support element or pallet 33 together with the mutually bearing wound product packages, $W_1$, $W_2$, $W_3$ and $W_4$ located thereon is transported in such a fashion to the further tilting mechanism or device 34 that the support arms 39 and 40 of the first support or support member 36 engage beneath the support element or pallet 33. Previously there is arranged or mounted at the support arms 37 and 38, extending in vertical direction, of the second support or support member 35 an other support element or pallet 45 which is depicted in FIG. 5 constitutes an other movable transport element.

Now by placing into operation the drive or drive maens 44 the tilting mechanism or device 34 is tilted through an angle of approximately 90° in the direction of the arrow F, as shown in FIG. 5. As a result, the essentially equal size wound product packages $W_1$, $W_2$, $W_3$ and $W_4$ which are reposing upon one another, are brought into a position in which they are arranged adjacent one another, that is to say, again into a position where the mutually aligned lengthwise axes 4*a* again extend essentially in horizontal direction as was originally the case. The now adjacently arranged or side-by-side oriented wound product packages $W_1$, $W_2$, $W_3$ and $W_4$ now bear at their outer surface or circumference upon the other support element or pallet 45. The arresting ledges or ledge members 46 and 47 or equivalent structure prevent the wound product packages $W_1$, $W_2$, $W_3$ and $W_4$, from unintentionally rolling away from or off the other support element or pallet 45.

Figure 7:
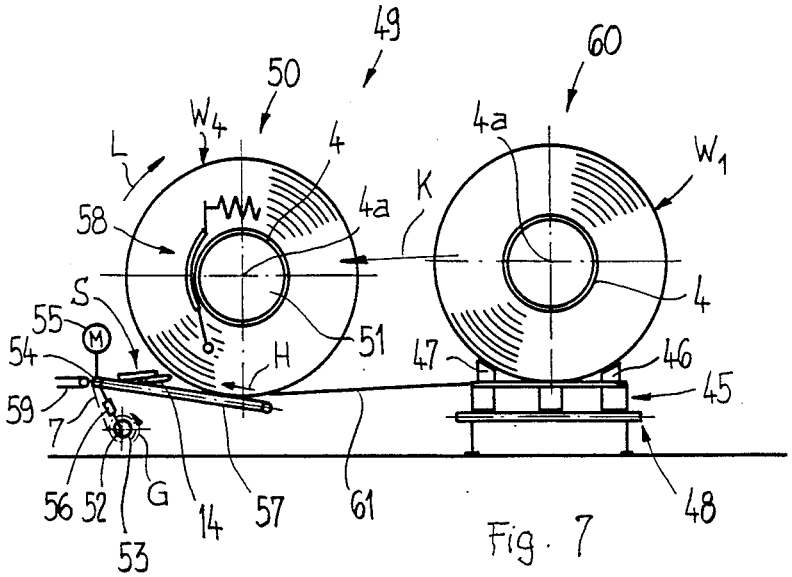
FIG. 7 is a side view of an unwinding or wind-off station.
Figure 8:
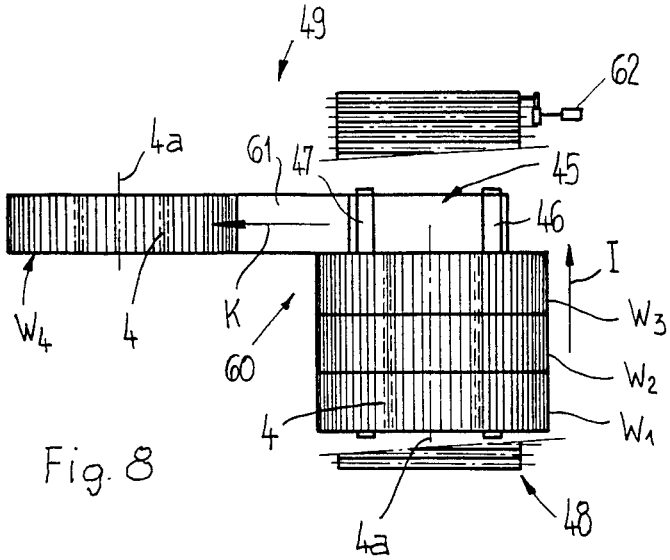
FIG. 8 is a top plan view of the unwinding or wind-off station depicted in FIG. 7.

The loaded support element or pallet 45 which bears upon a roller track 48 or equivalent structure is now transported upon such roller track 48 to an unwinding or wind-off station 49 which has been depicted in FIGS. 7 and 8.

This unwinding station 49 is quite similar to the wind-up station 1 shown in FIGS. 1 and 2 and possesses a mounting or support arrangement or unit 51 which defines an unwinding position or location 50. This mounting or support arrangement 51 serves for rotatably mounting the wound product package W for rotation about an essentially horizontally extending axis 4*a*. Additionally, there is provided a mounting or support arrangement or unit 52 for take-up or receiving spools or reels 53 for each winding band or strap 7. This winding band or strap 7 is guided over a drive roll or roller 54 which is driven by a suitable drive motor 55 which, by means of a winder or winding transmission or gearing unit 56, rotates the take-up spool 53 in the direction of the arrow G. Additionally, the drive motor 55 drives a band or belt conveyor 57 which is constructed as a rocker or balance or balance arm, and the conveying direction of this band or belt conveyor 57 has been indicated in FIG. 7 by reference character H. The band or belt conveyor 57 is pivotably mounted about an xis which coincides with the axis of rotation of the drive roll or roller 54. Moreover, a brake arrangement or brake unit 58 is provided and which acts upon the winding core or mandrel 4. The band or belt conveyor 57 has arranged thereafter an outfeed conveyor or outfeed device 59.

Arranged in neighboring relationship to the wind-off position or location 50 is a magazine or storage unit 60. The other support elements or pallets 45 loaded with the wound product packages $W_1$, $W_2$, $W_3$ and $W_4$ which are to be unwound or unreeled are brought to this magazine or storage unit 60. Such magazine or storage unit 60 is connected with the wind-off position or location 50 by a slightly descending roll or rolling track 61 or equivalent structure.

For transporting the loaded other support elements or pallets 45 from the further tilting mechanism or device 34 to the magazine or storage unit 60 the roller track 48 is driven in the direction of the arrow I by means of a suitable drive or drive unit 62.

The wound product packages W which are to be unwound are rolled from the other support element or pallet 45 over the roll or rolling track 61 in the direction of the arrow K into the wind-off position or location 50, as such has been depicted in FIGS. 7 and 8 for the wound product package $W_4$. By driving the drive roll 54 the winding band or strap 7 and togther therewith the wound-up printed products 14 are wound or payed-off the wound product package $W_4$ and outfed by means of the band conveyor 57 and the outfeed device or conveyor 59. The unwound winding band or strap 7 is wound onto the associated take-up spool or reel 53. The wound product package $W_4$ which rotates in the direction of the arrow L (FIG. 7) is slightly braked by means of the brake arrangement or brake unit 58. The unwinding of the printed products 14 from the wound product package W is accomplished basically in the manner disclosed in the aforementioned Swiss Patent No. 649,062 and the corresponding U.S. Pat. No. 4,438,618 to which the reference may be readily had and the disclosure of which is incorporated herein by reference.

As soon as all of the products of a wound product package, for instance the wound product package $W_4$, have been unwound, the then empty winding core or mandrel 4 is removed from the associated unwinding position or location 50. The same also holds true for the take-up spool or reel 53 together with the thereon wound winding band or strap 7. In the meantime the other support element or pallet 45 has been advanced or displaced in the direction of the arrow I, so that the next wound product package $W_3$ is brought into a position which is aligned with the roll or rolling track 61. This wound product package $W_3$ can now be rolled to the unwinding or wind-off position or location 50 as soon as such is ready for the reception of this wound product package $W_3$. After accomplishing the requisite connection of the winding band or strap 7 of the wound product package $W_3$ with the take-up spool or reel 53 there can be initiated the unwinding of the printed products 14 from such wound product package $W_3$. In corresponding manner there are successively also rolled into the unwinding position or location 50 and unwound thereat the remaining wound product packages $W_2$ and $W_1$.

By virtue of the described tilting of each of the wound product packages in each instance about a horizontal axis **29*a* or 41*a*, as the case may be, through an angle of approximately 90° it is possible in a most simple fashion to place the wound product packages in a favorable position for transportation and storage thereof, in that they bear upon one another with the lengthwise axes 4*a* extending in vertical direction. However, the wound product packages $W_1$, $W_2$, $W_3$ and $W_4$ can be removed very quickly and in a simple fashion from the wind-up position or location 2 and inserted into the unwinding position or loction 50 because the wound product packages $W_1$, $W_2$, $W_3$ and $W_4$ assume a position in which their lengthwise axes 4*a*** extend in horizontal direction, as such is desired for the wind-up or winding-up operation and the unwinding or unreeling operation.

Although from the standpoint of time and the expenditure in equipment it is advantageous to roll the wound product packages $W_1$, $W_2$, $W_3$ and $W_4$ onto the support element or pallet 16 and to roll such off of the other support element or pallet 45, it is also possible to remove the wound product packages $W_1$, $W_2$, $W_3$ and $W_4$ in a different way, for instance by loading devices, from the wind-up position or location 2 and to place such onto the support element or pallet 16 or, as the case may be, to raise such off the other support element or pallet 45 and to insert such into the unwinding position or location 50.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of processing printed products arriving in an imbricated formation, especially newspapers, periodicals and the like, comprising the steps of:

infeeding an imbricated formation of printed products to a hollow substantially cylindrical rotating winding core which rotates about an essentially horizontal axis of rotation with a flat side of each of the printed products confronting the hollow substantially cylindrical rotating winding core to form a wound product package;

placing one after another a plurality of such wound product packages adjacent one another with lengthwise axes thereof extending in substantially horizontal direction upon a support element constituting a movable transport element;

bringing said support element conjointly with said plurality of wound product packages placed upon said support element, to a tilting device containing two mutually substantially perpendicular supports;

arranging said support element conjointly with said plurality of wound product packages placed upon said support element, at a first one of said two supports of said tilting device;

placing an empty further support element constituting a further movable transport element at a second one of said two supports of said tilting device and adjacent said plurality of wound product packages placed upon said support element arranged at said first support of said tilting device;

conjointly tilting said first and second supports of said tilting device about a common pivot axis extending in a substantially horizontal direction through substantially 90° and thereby displacing said plurality of wound product packages from said support element to said further support element, thus forming, on said further support element, a stack formed by said plurality of wound product packages with said lengthwise axes thereof extending in substantially vertical direction; and moving said further support element conjointly with said stack formed by said plurality of wound product packages away from said tilting device.

2. The method as defined in claim 1, wherein:

said step of placing said plurality of wound product packages upon said support element entails rolling the wound product packages out of a wind-up location onto said support element.

3. The method as defined in claim 1, wherein:

said step of moving said further support element away from said tilting device entails selectively conveying said further support element conjointly with said stack formed by said plurality of wound product packages to any one of either (i) a storage location or (ii) an unwinding station.

4. The method as defined in claim 1, further including the step of:

utilizing a respective pallet as the support elements constituting said movable transport elements.

5. The method as defined in claim 3, further including the step of:

transporting said further support element conjointly with said stack formed by said plurality of wound product packages to a further tilting device;

tilting said wound product packages about a substantially horizontal axis back through substantially 90° onto an additional support element into a position where the lengthwise axis of each of the wound product packages extends substantially in horizontal directon and with the wound product packages located adjacent one another; and then delivering the wound product packages conjointly with said additional support element to an unwinding station.

6. A method of processing printed products, such as newspapers, periodicals and the like, wound in an imbricated formation and in conjunction with a winding band upon a hollow substantially cylindrical winding core, to form a wound product package, wherein the printed products together with the winding band are subsequently unwound from the wound product package, comprising the steps of:

prior to unwinding the wound product packages arranging a stack of a plurality of said wound product packages upon a support element constituting a movable transport element and in an orientation wherein said plurality of wound product packages bear upon one another with the lengthwise axis of each wound product package extending substantially in vertical direction;

moving said support element conjointly with said stack formed by said plurality of wound product packages to a tilting device containing two mutually substantially perpendicular supports;

arranging said support element conjointly with said stack formed by said plurality of wound product packages placed upon said support element, at a first one of said two supports of said tilting device;

placing another empty support element constituting another movable transport element at a second one of said two supports of said tilting device and adjacent said stack formed by said plurality of wound product packages placed upon said support element arranged at said first support of said tilting device;

conjointly tilting said first and second supports of said tilting device about a common pivot axis extending in a substantially horizontal direction through substantially 90° and thereby displacing said stack formed by said plurality of wound product packages from said support elemen to said another support element, to thereby form on said another support element an arrangement of said plurality of wound product packages with their lengthwise axes extending in substantially horizontal direction;

conveying said another support element conjointly with said arrangement of said plurality of wound product packages to an unloading location, and successively delivering each of said wound product packages from said unloading location to an unwinding location.

7. The method as defind in claim 6, further including the step of:

utilizing a respective pallet as said support elements constituting said movable transport elements.

8. The method as defined in claim 6, wherein said step of delivering said wound product packages entails successively rolling the adjacently arranged wound product packages to an unwinding station at said unwinding location.

9. An apparatus for processing printed products, especially newspapers, periodicals and the like, wound in an imbricated formation and in conjunction with a winding band upon a hollow substantially cylindrical winding core to form wound product packages, comprising:

a stationary tilting device for the conjoint tilting through an angle of substantially 90° a plurality of wound product packages arranged adjacent one another on a movable transport element with lengthwise axes thereof extending in substantially horizontal direction;

said stationary tilting device comprising two supports disposed approximately at right angles with respect to one another;

means defining a pivot axis for said two supports;

said pivot axis extending substantially in horizontal direction;

means for pivoting said two supports conjointly through an angle of approximately 90° about said pivot axis;

a first one of said two supports receiving said movable transport element conjointly with said plurality of wound product packages to be conjointly tilted;

a second one of said two supports being provided with a number of mutually parallel support arms arranged in spaced relationship from one another for removably receiving and holding a support element for said plurality of wound product packages after tilting;

means for loading said movable transport element conjointly with said wound product packages onto said first one of said two supports of said tilting device; and means for removing said support element conjointly with said tilted plurality of wound product packages from said second one of said two supports of said tilting device.

10. The apparatus as defined in claim 9, wherein:

said support element and said transport element comprise pallets.

11. The apparatus as defined in claim 9, wherein:

said means for loading said movable transport element conjointly with said wound product packages further comprise conveyor means for moving said transport element supporting said plurality of wound product packages to be tilted from a loading location onto said first one of said two supports of said tilting device.

12. The apparatus as defined in claim 11, wherein:

said conveyor means comprise a roller track.

13. An apparatus for processing printed products, especially newspapers, periodicals and the like, arriving in an imbricated formation, comprising:

a winding station (1) having a winding location (2) for winding the imbricated formation in conjunction with a winding band (7) upon a hollow substantially cylindrical winding core (4) which rotates about an essentially horizontal axis (**4*a***) of rotation to form wound product packages ($W_1 \ldots W_4$), comprising:

a loading station (15) for loading a first support element (16) constituting a movable transport element with a plurality of wound product packages ($W_1 \ldots W_4$) produced at said winding locations (2) by successively placing said wound product packages adjacent one another with lengthwise axes (**4*a*) thereof extending in substantially horizontal directon upon said first support element (16**);

a stationary tiliting device (22) comprising two supports (23, 24) disposed approximately at right angles with respect to one another;

means defining a pivot axis (**29*a*) for said two supports (23, 24**);

said pivot axis (**29*a***) extending substantially in horizontal direction;

means (32) for pivoting said two supports (23, 24) conjointly through an angle of approximately 90° about said pivot axis (**29*a***);

a first one (23) of said two supports receiving said first support element (16) and the plurality of wound product packages placed thereon;

a second one (24) of said two supports removably receiving and holding a second empty support element (33) constituting a further movable transport element for receiving said plurality of wound product packages after tilting;

first transport means (17) for moving said first support element (16) loaded with said plurality of wound product packages ($W_1 \ldots W_4$) from said loading station (15) to said tilting device (22), and second transport means for removing said second support element (33) conjointly with said tilted plurality of wound product packages forming a stack with lengthwise axes thereof extending in substantially vertical direction from said tilting device (22).

14. The apparatus as defined in claim 13, wherein:

said first support element and second support element comprise pallets.

15. The apparatus as defined in claims 13, wherein:

said loading station (15) is arranged adjacent to the winding location (2):

said loading station (15) being connected with said winding location (2) by means of a roll track (19) upon which the completed wound product packages ($W_1 \ldots W_4$) are rolled-out of the winding location (2) onto said first support element (16).

16. The apparatus as defined in claim 13, further comprising:

conveyor means (17, 18) arranged at the loading station (15) for advancing step-by-step said first support element (16) to be loaded in the direction of the lengthwise axis (4*a*) of the wound product packages ($W_1 \ldots W_4$) resting upon said first support element (16).

17. The apparatus as defined in claim 13, wherein:

said first transport means comprise a drivable roller track (17).

18. The apparatus as defined in claim 13, wherein:

said supports (23, 24) are provided with two supports arms (25, 26; 27, 28) arranged parallel to one another and in spaced relationship from one another, said first and second support elements (16, 33), respectively, being movable onto said support arms.

19. The apparatus as defined in claim 13, wherein:

said first support element (16) is provided with arresting means (20, 21) extending substantially parallel to the lengthwise axis (4*a*) of the wound product packages ($W_1 \ldots W_4$) resting upon said first support element (16).

20. An apparatus for processing printed products, especially newspapers, periodicals and the like, wound in an imbricated formation (S) and in conjunction with a winding band (7) upon a hollow substantially cylindrical winding core (4) to form wound product packages ($W_1 \ldots W_4$), comprising:

an unwinding station (49) having an unwinding location (50) for unwinding the printed products (14) together with the winding band (7) from the wound product packages ($W_1 \ldots W_4$);

a stationary tilting device (34) comprising two supports (35, 36) disposed approximately at right angles with respect to one another;

means defining a pivot axis (41*a*) for said two supports (35, 36);

said pivot axis (41*a*) extending substantially in horizontal direction;

means (44) for pivoting said two supports (35, 36) conjointly through an angle of approximately 90° about said pivot axis;

a first one (35) of said two supports receiving a first support element (33) carrying a stack formed by the plurality of wound product packages ($W_1 \ldots W_4$) bearing upon one another with a lengthwise axis of each wound product package extending substantially in vertical direction;

a second one (36) of said two supports removably receiving and holding a second empty support elements (45) constituting a further movable transport element for receiving said plurality of wound product packages ($W_1 \ldots W_4$) after tilting;

an unloading station (60) for unloading said second support element 845) loaded with said plurality of wound product packages ($W_1 \ldots W_4$) which are arranged adjacent one another with lengthwise axes (4*a*) extending in substantially horizontal direction upon said second support element (45) by successively bringing said wound product packages ($W_1 \ldots W_4$) to said unwinding location (50);

first transport means for bringing said first loaded support elements (33) to the tilting device (34), and second transport means (48) for bringing said loaded second support elements 845) from said tilting device (34) to said unloading station (50) after tilting.

21. The apparatus as defined in claim 20, wherein:

said unloading station (60) is arranged adjacent the unwinding location (50), said unloading station (60) being connected with said unwinding location (50) by means of a roll track (61) upon which the wound product packages ($W_1 \ldots W_4$) are rolled from said second support element (45) to the unwinding location (50).

22. The apparatus as defined in claim 20, further comprising:

conveyor means (48, 62) arranged at the unloading station (60) for advancing step-by-step said second support element (45) to be unloaded in the direction of the lengthwise axis (4*a*) of the wound product packages ($W_1 \ldots W_4$) resting upon said second support element (45).

23. The apparatus as defined in claim 20, wherein:

said second transport means comprise a driveable roller track (48). .

24. The apparatus as defined in claim 20, wherein:

said two supports (35, 36) being provided with two mutually parallel support arms (37, 38, 39, 40) arranged in spaced relationship from one another for removably receiving and holding said first and second support element (33, 45), respectively.

25. The apparatus as defined in claim 20, wherein:

said second support element (45) is provided with arresting means (46, 47) extending substantially parallel to the lengthwise axis (4*a*) of the wound product packages ($W_1 \ldots W_4$) resting upon said second support element (45).

26. The apparatus as defined in claim 20, wherein:

said first support element (33) and said second support element (45) comprise pallets.

* * * * *